US006059178A

United States Patent [19]

Malloy et al.

[11] Patent Number: 6,059,178

[45] Date of Patent: May 9, 2000

[54] TAMPER EVIDENT SHIPPING CONTAINER

[75] Inventors: James F. Malloy, West Hartford; Gregory Malloy; Joseph Novak, both of Windsor, all of Conn.

[73] Assignee: All Crate, Inc., Windsor, Conn.

[21] Appl. No.: 09/153,421

[22] Filed: Sep. 15, 1998

[51] Int. Cl.[7] ..... B65D 5/02

[52] U.S. Cl. ..... 229/102; 229/136; 229/154; 229/939

[58] Field of Search ..... 229/102, 132, 229/136, 154, 939; 206/807, 813

[56] References Cited

U.S. PATENT DOCUMENTS

| | | | |
|---|---|---|---|
| Re. 23,204 | 3/1950 | Zinn, Jr. | 229/154 |
| Re. 26,742 | 12/1969 | Laskow | 229/136 |
| 1,223,232 | 4/1917 | Ash | 229/154 |
| 1,863,260 | 6/1932 | Van Buren | 229/154 |
| 3,140,809 | 7/1964 | Hickin et al. | 229/136 |
| 4,848,589 | 7/1989 | Olson et al. | 229/136 |
| 5,499,713 | 3/1996 | Huffer | 206/813 |

*Primary Examiner*—Gary E. Elkins
*Attorney, Agent, or Firm*—McCormick, Paulding & Huber LLP

[57] ABSTRACT

A tamper evident shipping container comprising a generally rectangular box formed from corrugated paper board includes a pair of overlapping top closure panels adhered together in sealed condition by multiple strips of pressure sensitive adhesive disposed therebetween and a pair of overlapping bottom closure panels sealed together in a like manner. Retaining tabs connected to opposite ends of one of the top closure panels and one of the bottom closure panels are adhered to the end walls of the container by pressure sensitive adhesive. The flutes or corrugations which comprise the container material extend transversely of the retaining tabs and the free edges of the top and bottom closure panels so that attempted entry of the container in the regions of seal causes creasing of the container material along the lines of scorrugation. The resulting creases are readily evident from a cursory inspection of the sealed container.

9 Claims, 2 Drawing Sheets

TAMPER EVIDENT SHIPPING CONTAINER

BACKGROUND OF THE INVENTION

This invention relates in general to shipping containers and deals more particularly with an improved container of a tamper indicating type.

Although the container of the present invention is generally adapted for shipping goods of all types, it is particularly well suited for use as an air freight shipping container. A typical air freight shipment generally contains a plurality of small, individually packaged articles of relatively high value, as, for example, watches, cameras, designer clothing and accessories, such as women's handbags and shoes or other small high cost items. Such shipments are often prepared by air freight forwarders. The shipping containers used in such shipments must be strong to withstand rough handling, provide a high degree of security and be adapted for rapid set up with a minimum of taping and/or strapping to minimize material and labor costs in preparing the shipment.

An air freight shipment will usually pass through several hands before reaching its final destination. The shipment may, for example, be transported by one or more trucking companies and be loaded and unloaded by cargo handlers at two or more air terminals before final delivery. Cargo handlers and others having access to a shipment during transit can usually determine the contents of a shipping container from a bill of lading or a packing slip which may be attached to the container. When a shipment contains small articles having a high "street value", the shipment will often become a target for pilferage. Theft losses often occur because a thief is able to free a portion of a closure flap on an insecure container, reach under the flap and slit the container wall beneath the flap to gain access to the contents of the container. If a container is sealed with tape, it sometimes possible for a thief to remove a strip of tape from the container to gain access to the contents of the container and thereafter replace the tape with another strip of like kind. If the point of container entry can be easily concealed, the loss may remain undetected until the shipment reaches its final destination. Then it is usually difficult, if not impossible, to determine the en route location where the loss occurred. The inability to promptly detect when container tampering occurs tends to encourage the practice and poses serious problems for both airlines and associated freight handling companies.

Accordingly, it is the general aim of the present invention to provide an improved shipping container which affords high strength, durability and a high degree of security against unauthorized entry to discourage pilferage. It is a further aim of the invention to provide an improved container particularly adapted for rapid setup and which may be sealed without the use of tape and/or strapping which tends to become fouled with conveyors and other cargo handling equipment. Yet another aim of the invention is to provide an improved shipping container of tamper indicating type whereby evidence of tampering may be readily detected by cursory inspection of the container in transit so that any attempted container entry or other improper handling of a shipment may be promptly detected and investigated to discourage reoccurrence.

SUMMARY OF THE INVENTION

In accordance with the present invention a tamper evident container comprises a generally rectangular folding box formed from a paperboard blank and including a plurality of panels connected together along associated fold lines. The box has a rectangular bottom, side and end walls. Top closure flaps integrally connected to the upper edges of the opposite end walls of the container are foldable inwardly toward each other and to a closed position. Top closure panels integrally connected to the upper edges of the container side walls along associated fold lines are foldable inwardly and to closed position overlying the top closure flaps. One of the top closure panels overlaps at least an associated portion of the other of the top closure panels in closed position and carries a pair of top retaining tabs. Each top retaining tab is formed from a portion of an associated top closure flap and is integrally connected to an associated end of the one top closure panels along a fold line. The container further includes adhesive means for adhering a portion of the one top closure panel to the underlying portion of the other of the top closure panels and for adhering the top retaining tabs to the end walls of the container when the container is sealed in closed position.

DETAILED DESCRIPTION OF PREFERRED EMBODIMENT

Figure 1:
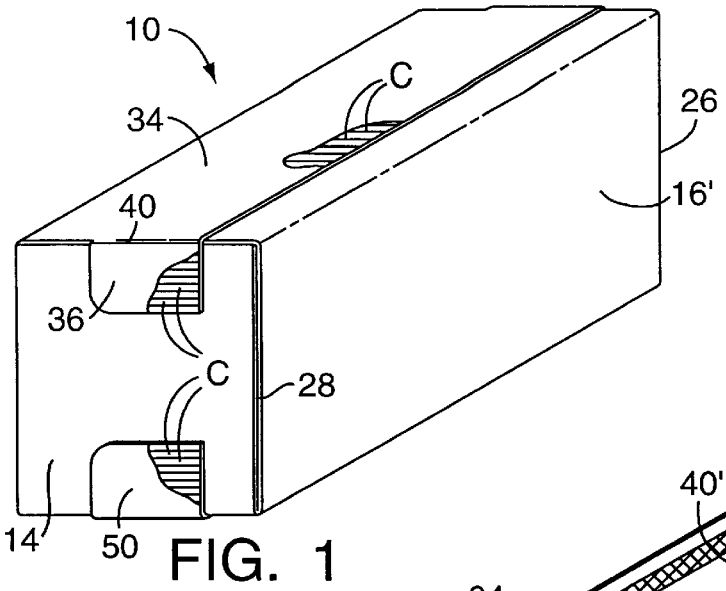
FIG. 1 is a perspective view of a tamper evident container embodying the present invention and shown sealed in closed position.

Turning now to the drawings, a tamper evident container embodying the present invention and indicated generally by the reference numeral 10 is shown in FIG. 1 in a closed and sealed condition. The illustrated container 10 is particularly adapted for use as an air freight shipping container and is further shown in FIG. 3 in a partially setup condition. The container blank from which the air freight container 10 is formed is generally rectangular, illustrated in FIG. 2, designated generally by the numeral 12, and preferably made from durable multi-ply corrugated paperboard. The surface of the container blank 12 shown in FIG. 2 generally defines the inner surfaces of the set-up container 10, as will be hereinafter further evident.

Figure 3:
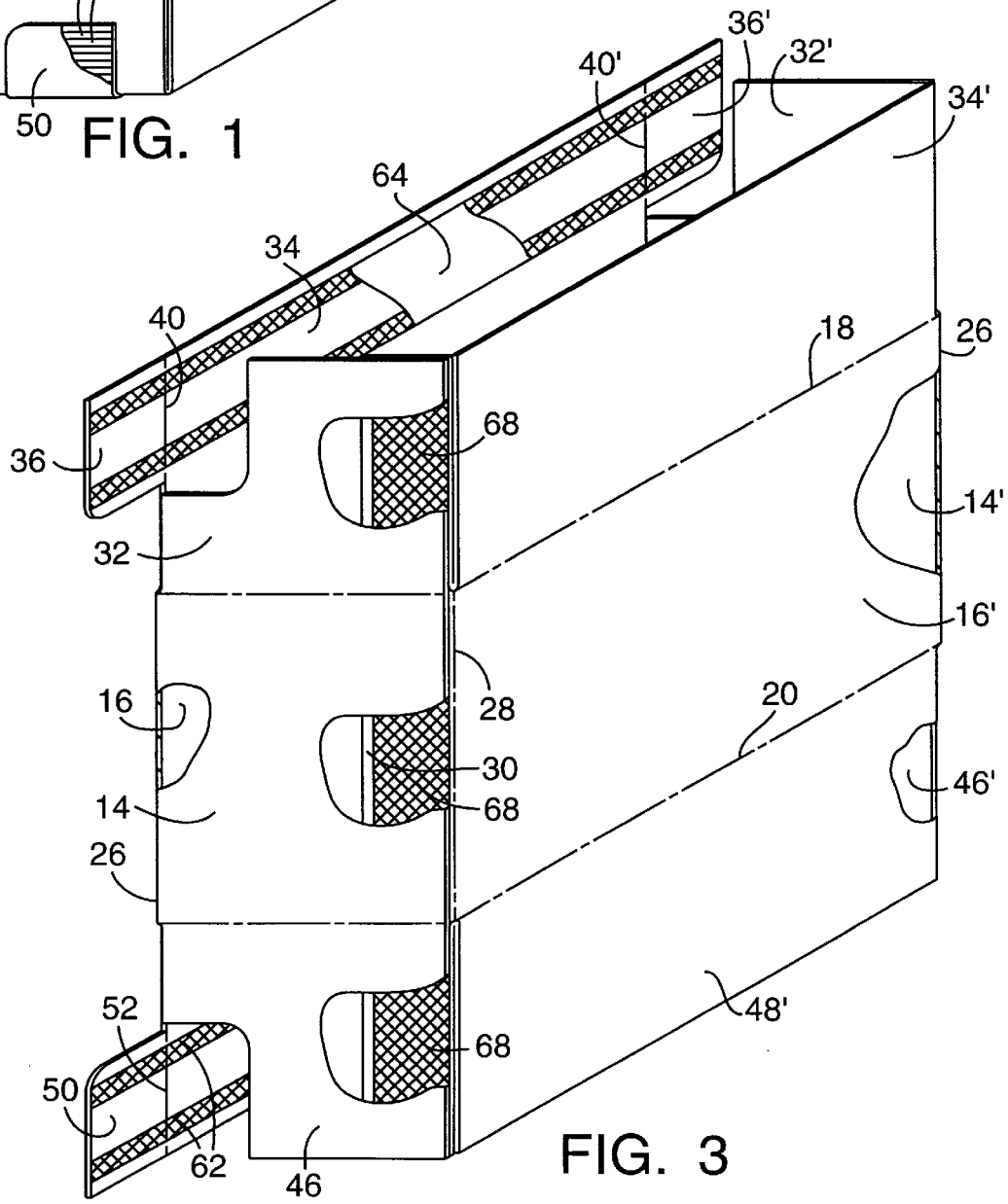
FIG. 3 is a perspective view of the container blank used to make the container of FIG. 1 shown in a partially set up condition.
Figure 2:
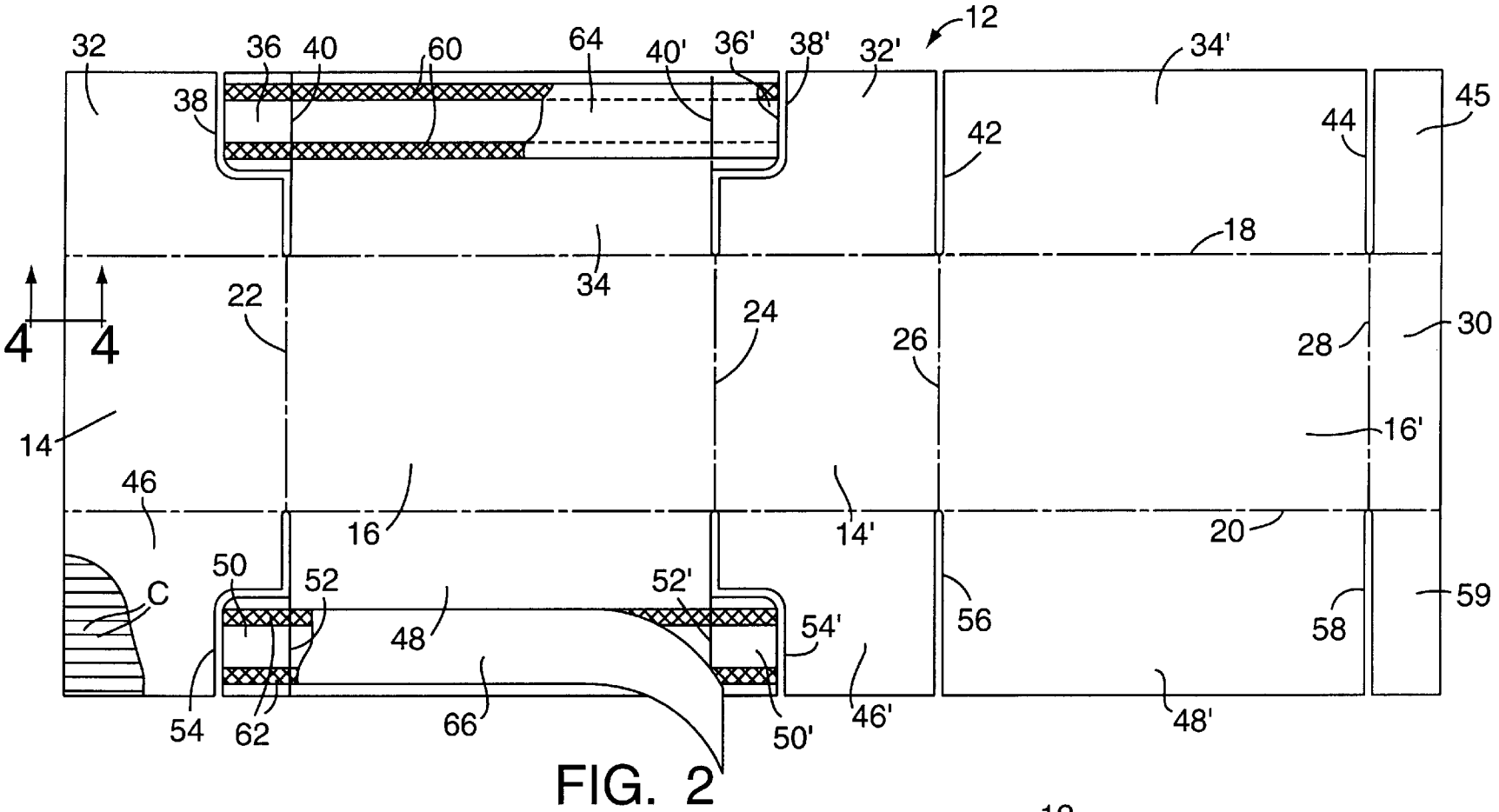
FIG. 2 is a somewhat enlarged plan view of a container blank used to make the tamper evident container shown in FIG. 1.
Figure 4:
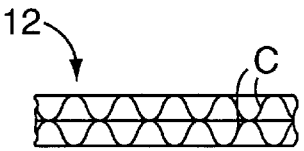
FIG. 4 is a somewhat enlarged fragmentary sectional view taken along the line 4—4 of FIG. 2.

Referring now to the container blank 12, as shown oriented in FIG. 2, and the partially setup container formed from the blank 12, as it appears in FIG. 3, the container blank 12 defines a pair of longitudinally opposing and generally vertically disposed container end walls 14, 14' and a pair of laterally opposing generally vertically disposed rectangular sidewalls 16, 16'. The side and end walls are generally rectangular and partially defined by a pair of parallel upper and lower fold lines indicated at 18 and 20, respectively, which extend longitudinally across the container blank 12 in a horizontal direction, as shown in FIG. 3. The flutes or corrugations between the multiple layers of corrugated paper board from which the blank 12 is formed extend transversely of the blank as shown in FIGS. 2 and 4 wherein the corrugations are indicated by the letter C. The purpose of this arrangement of the corrugations relative to the container blank will be hereinafter further evident.

Additional fold or score lines formed on the container blank 12 and indicated at 22, 24 and 26 extend transversely between the horizontal fold lines 18 and 20, further define the end walls 14, 14' and the side walls 16, 16', and provide foldable connection between the end walls and side walls, substantially as shown in FIG. 3. Another fold line indicated at 28 extends vertically between the fold lines 18 and 20 and provides foldable connection between the side wall 16' and a connecting panel indicated 30 and located at the right-hand end of the container blank 12, as it appears in FIG. 2.

The top and bottom walls of the container 10, as shown in FIG. 1, are preferably of substantially identical construction. Further referring to FIG. 3, the top wall is formed by a pair of top closure flaps 32, 32' and a pair of top closure panels which include an outer top closure panel 34, and an inner top closure panel 34'. The top closure flaps 32, 32' are connected to the end walls 14 and 14', respectively, along associated portions of the upper fold line 18. In like manner, the top closure panels 34 and 34' are connected to the side walls 16 and 16', respectively, along other portions of the upper fold line 18. The outer top closure panel 34 carries a pair of top retaining tabs 36, 36' formed by portions of the top closure flaps 32, 32'. The top retaining tabs 36, 36' are separated from the top closure flaps 32 and 32', respectively, along lines of shear or severance 38, 38' which also further separate the top closure panels 34, 34' from the top closure flaps, substantially as shown in FIG. 3. Each of the top retaining tabs 36, 36' is connected to the outer top closure flaps 34, 34' along an associated fold line, the fold lines being indicated at 40, 40'.

The inner top closure panel 34' is generally rectangular and separated from the top closure flap 32' by a transversely extending line of severance 42 which extends from the fold line 18 to the free upper edge of the container blank 12 and forms an upwardly extending transverse extension of the fold line 26, as shown in FIG. 2. The closure panel 34' is further defined by another line of severance 44 which separates an upper portion of the connecting panel 30 from the top closure panel 34', the upper portion being indicated at 45.

As previously noted, the construction of the bottom wall of the container 10 is substantially identical to the construction of the top wall and is formed by a pair of bottom closure flaps 46, 46' connected to the end walls 14, 14' and a pair of bottom closure panels 48, 48' connected to the side walls 16, 16' along the lower fold line 20. Like the outer top closure panel 34, the outer bottom closure panel 48 carries a pair of bottom retaining tabs 50, 50' and is dimensioned to overlie an associated portion of the opposite bottom closure panel 48' when the container 10 is set-up. The latter retaining tabs are connected to the outer bottom closure panel 48 along fold lines 52, 52' and are cut from the bottom closure flaps 46 and 46', respectively, and separated from the bottom closure flaps along lines of severance 54, 54' which also separate the bottom closure panel 48 from the bottom closure flaps 46, 46'.

The bottom closure panel 48' is similar to the top closure panel 34' in that it is a rectangular panel separated from the immediately adjacent bottom closure flap 46' by a transversely extending line of severance 56 which forms a downward extension of the fold line 26, as shown in FIG. 2. The bottom closure panel 48' is further defined by another line of severance 58, which like the line of severance 44, separates the bottom closure panel 48' from a downwardly extending lower portion of the connecting panel 30, the lower portion of the connecting panel being indicated at 59.

The container blank 12 as shown in FIG. 2 and hereinbefore described may, for example, be formed from a continuously advancing web of corrugated paper board using rotary forming apparatus. At least one longitudinally extending strip of adhesive is applied to the top closure panel 34 and the bottom closure panel 48 and the retaining tabs 36, 36' and 50, 50' respectively attached to the latter panels. However, in accordance with presently preferred practice a plurality of transversely spaced apart and longitudinally extending strips of adhesive are applied to each of the aforesaid panels, as shown in FIG. 2. Specifically, two such spaced apart strips of adhesive are applied to each of the panels 34 and 48. The top closure panel 34 and its associated retaining tabs 36 and 36' carry two strips of adhesive indicated at 60, 60. In like manner the bottom closure panel 48 and its associated retaining tabs 50 and 50' carry two strips of adhesive indicated at 62, 62, pressure sensitive adhesive being preferred. A hot melt high tack adhesive is presently preferred for this purpose. The longitudinally extending strips of adhesive are preferably applied in close proximity to the longitudinally extending free edges of the top and bottom closure panels and the retaining tabs attached thereto.

A single strip of release material, indicated at 64 in FIG. 2, is applied to the outer top closure panels 34 to cover the multiple strips of pressure sensitive adhesive 60, 60 applied thereto. Another strip of release material 66 covers the two strips of adhesive 62, 62 on the outer bottom closure panel 48 and the retaining tabs 50, 50' carried by the bottom closure panel.

Before the container blank 12 shown in FIG. 2 can be set up to form the container 10 the connecting panel 30 must be joined to the end panel 14. The connecting panel 30 is first folded inwardly along the fold line 28 from its position in FIG. 2 to a position wherein the panel 30 overlies an associated portion of the side panel 16'. A strip of adhesive 68 is then applied to the exposed surface of the panel 30 and also to the exposed surfaces of the panels 45 and 59 which now overly the top and bottom closure panels 34' and 48', respectively, the adhesive strip 68 being best shown in FIG. 3. Thereafter, the side panel 16 is folded along the fold line 24 from its position of FIG. 2 and toward the connecting panel 30 to bring marginal portions of the panels 32, 14 and 46 into adhering engagement with panels 45, 30 and 59, respectively, which now carry the strip of adhesive 68. Thus, a knocked-down container blank is prepared. The knocked-down blank may be stored in its knocked-down or flat folded position until it is ready to be set-up to form a shipping container.

In FIG. 3 the container blank 12 is shown after it has been unfolded from its flat folded or knocked-down position to a partially set-up position. The container blank 12 is further set-up by completing the assembly of the bottom wall. The bottom wall assembly is made by first folding the bottom end flaps 46 and 46' inwardly toward each other along the fold line 20. Thereafter, the inner bottom closure panel 48' is folded inwardly or toward the opposite side wall 16 along the fold line 20 and into overlying relation with the previously folded bottom end flaps 46 and 46'. Assembly of the bottom wall of the container is completed by stripping the release material 66, shown in FIG. 2, from the outer bottom closure panel 48 and its associated retaining tabs 50, 50' to expose the strips of pressure sensitive adhesives 62, 62 thereon. When the pressure sensitive adhesive strips 62, 62 have been exposed the bottom closure panel 48 is pressed against an associated portion of the previously folded bottom closure panel 48' so that the pressure sensitive adhesive strips 62, 62 carried by the closure panel 48 adhere to the closure panel 48'. The bottom retaining tabs 50 and 50' are next folded upwardly along respectively associated fold lines 52 and 52' and into adhering engagement with the end walls 14 and 14' to complete assembly of the container bottom wall. The container is now set-up and ready to receive the articles to be shipped.

After the container has been packed the top closure flaps 32, 32' are folded inwardly toward each other. Thereafter, the inner top closure panel 34' is folded inwardly along the fold line 18 and into overlying relation to the previously folded top closure flaps 32 and 32'. The container is then sealed by stripping the release material 64 from the outer top closure panel 34 and its associated top retaining tabs 36, 36' to expose the strips of adhesive 60, 60, after which the top closure panel 34 is folded into overlying relation and adhered to an associated portion of the previously folded top closure panel 34'. The container sealing operation is completed by folding the top retaining tabs 36 and 36' downwardly and inwardly along fold lines 40 and 40', respectively, and into adhering engagement with the end walls 14 and 14'. It should be noted that the top and bottom closure panels 34 and 48 are dimensioned so that the entire width of each retaining tab overlies an associated opposite closure panel.

Referring now particularly to FIG. 1, it will be noted that the flutes or corrugations C, C which comprise the container material extend transversely of the retaining tabs 36 and 50, substantially as shown. Thus, any attempt to slide a thin instrument between one of the retaining tabs 36 or 50 and the end wall 14 to pry the retaining tab away from the end wall will result in transverse creasing of the tab along one or more of its corrugations C, C. In like manner an attempt to pry the top closure panel 34 loose from the underlying top closure panel 34' will result in at least some creasing of the corrugations forming the closure panel 34. Thus, any unauthorized attempt to gain access to the container 10 in the sealing regions of the container will be evident from a cursory inspection of the container and particularly the areas in which the container is sealed.

Since tape is not required to seal the container the opportunity for concealed entry by removing and replacing tape does not exist.

We claim:

1. A tamper evident container comprising a generally rectangular box formed from a corrugated paperboard container blank, said box having a pair of opposing vertically disposed rectangular end walls, a pair of opposing vertically disposed rectangular sidewalls, a pair of top closure flaps, each of said top closure flaps being connected to an upper edge of an associated one of said end walls along a fold line for folding movement between open and close positions, said box having a pair of top closure panels including an inner top closure panel and an outer top closure panel, each of said top closure panels being connected to an upper edge of an associated one of said sidewalls along a fold line for folding movement between open and close positions, said inner top closure panel overlying associated portions of said top closure flaps in said closed position, said outer top closure panels overlying an associated portion of said inner top closure panel in said closed position, top retaining tabs connected to opposite ends of said outer top closure panel along associated fold lines, said top retaining tabs being formed by portions of said top closure flaps, each of said top retaining tabs overlying a portion of an associated one of said end walls when the container is in its closed position, and adhesive means for adhering a portion of said outer top closure panel to an underlying portion of said inner top closure panel and said top retaining tabs to said end walls when said container is in its closed position, said corrugated paperboard blank having parallel corrugations extending transversely of said top retaining tabs and in parallel relation to said fold lines connecting said top retaining tabs to said opposite ends of said outer top closure panel.

2. A tamper evident container as set forth in claim 1 wherein said inner and outer top closure panels are of substantially equal width.

3. A tamper evident container as set forth in claim 1 wherein said container blank is further characterized as a unitary rectangular container blank.

4. A tamper evident container as set forth in claim 1 wherein said adhesive means comprises at least one strip of adhesive extending along the entire length of said outer top closure panel and said retaining tabs.

5. A tamper evident container as set forth in claim 4 wherein said at least one strip of adhesive comprises a strip of pressure sensitive adhesive having an exposed surface and a strip of release material generally overlying and adhered to said exposed surface.

6. A tamper evident container as set forth in claim 4 wherein said adhesive means comprises a plurality of strips of pressure sensitive adhesive extending along the length of said outer bottom closure panel and said bottom retaining tabs.

7. A tamper evident container as set forth in claim 1 including a pair of bottom closure flaps, each of said bottom closure flaps being connected to a lower edge of an associated one of said end walls along a fold line for folding movement between open and close positions, said box having a pair of bottom closure panels including an inner bottom closure panel and an outer bottom closure panel, each of said bottom closure panels being connected to a lower edge of an associated one of said sidewalls along a fold line for folding movement between open and close positions, said outer bottom closure panel overlying associated portions of said bottom closure flaps in said closed position, said outer bottom closure panels overlying an associated portion of said inner bottom closure panel in said closed position, bottom retaining tabs connected to opposite ends of said outer bottom closure panel along associated fold lines, said bottom retaining tabs being formed by portions of said bottom closure flaps, each of said bottom retaining tabs overlying a portion of an associated one of said end walls when the container is in its closed position, and adhesive means for adhering a portion of said outer bottom closure panel to an underlying portion of said inner bottom closure panel and said retaining tabs to said end walls when said container is in its closed position, said corrugations extending transversely of said bottom retaining tabs and in parallel relation to said fold lines connecting said bottom retaining tabs to said opposite ends of said outer bottom closure panel.

8. A tamper evident container as set forth in claim 7 wherein said inner and outer bottom closure panels are of substantially equal width.

9. A tamper evident container as set forth in claim 7 wherein said container blank is further characterized as a unitary rectangular container blank.

* * * * *